US011800895B2

(12) United States Patent
Shen et al.

(10) Patent No.: US 11,800,895 B2
(45) Date of Patent: Oct. 31, 2023

(54) VAPORIZING APPARATUS AND VAPORIZER THEREOF

(71) Applicant: Polytronics Technology Corp., Hsinchu (TW)

(72) Inventors: Po-Chih Shen, Kaohsiung (TW); Tong-Cheng Tsai, Tainan (TW); David Shau-Chew Wang, Taipei (TW); Yu-Sian Jhuo, New Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 875 days.

(21) Appl. No.: 16/844,594

(22) Filed: Apr. 9, 2020

(65) Prior Publication Data

US 2021/0195953 A1 Jul. 1, 2021

(30) Foreign Application Priority Data

Dec. 30, 2019 (TW) ..... 108148397

(51) Int. Cl.
*A24F 40/44* (2020.01)
*A24F 40/46* (2020.01)

(52) U.S. Cl.
CPC ..... *A24F 40/44* (2020.01); *A24F 40/46* (2020.01)

(58) Field of Classification Search
None
See application file for complete search history.

(56) References Cited

U.S. PATENT DOCUMENTS

| | | | | |
|---|---|---|---|---|
| 2019/0166913 | A1 | 6/2019 | Trzecieski | |
| 2021/0030073 | A1* | 2/2021 | Yang | A24B 15/167 |
| 2021/0195953 | A1* | 7/2021 | Shen | A24F 40/44 |
| 2022/0104549 | A1* | 4/2022 | Shen | A24F 40/46 |

FOREIGN PATENT DOCUMENTS

| | | |
|---|---|---|
| TW | I-645790 B | 1/2019 |

* cited by examiner

*Primary Examiner* — James Harvey
(74) *Attorney, Agent, or Firm* — Muncy, Geissler, Olds & Lowe, P.C.

(57) ABSTRACT

A vaporizer comprises an absorber and a heating element. The absorber is configured to absorb the material to be vaporized and comprises a plurality of first pores of a 100-500 nm diameter and a plurality of second pores of a 20-100 nm diameter. A ratio of the number of the second pores N2 to the number of the first pores N1 in a unit area, i.e., N2/N1, is 10-50%. The heating element heats and vaporizes the material to be vaporized in the absorber.

14 Claims, 3 Drawing Sheets

VAPORIZING APPARATUS AND VAPORIZER THEREOF

BACKGROUND OF THE INVENTION

(1) Field of the Invention

The present application relates to a vaporizing apparatus and a vaporizer thereof.

(2) Description of the Related Art

Cigarettes take up a large space and are easily deformed or damaged when being carried. The users often need to find shops selling cigarettes when going outside for a long time. Traditional cigarettes need to be lighted by fire and generates waste like ash and cigarette butts. Therefore, ashtrays or specific trash cans are necessary to receive the wastes to avoid environmental contamination or fire.

To solve the above problems, personal vaporizing apparatuses such as electronic cigarettes have been widely developed for a decade as a substitute for cigarettes and cigars. Electronic cigarettes are usually sophisticated, and thus young people like to use them to show personal taste. The vaporizing apparatuses are developed continuously to increase efficiency and reliability and to lower manufacturing difficulty and cost.

An electronic cigarette usually uses a porous ceramic material to absorb cigarette oil that is the so-called e-liquid or e-juice and a heater to heat and vaporize the e-liquid. The porous ceramic material has to absorb e-liquid quickly in a short time period and therefore the pores cannot be too small. However, e-liquid leakage may be easily found for large pores. Moreover, the porous ceramic material may have drawbacks like insufficient amount and bland smell of smoke, and therefore it does not satisfy the requirements of the user and needs to be improved.

SUMMARY OF THE INVENTION

The present application provides a vaporizing apparatus and a vaporizer thereof in which an absorber includes pores of at least two different sizes to quickly absorb the material to be vaporized and enhance mechanical strength. The present application can be applied to an electronic cigarette to obtain a large amount and rich taste of smoke.

In accordance with a first aspect of the present application, a vaporizer comprises an absorber and a heating element. The absorber is configured to absorb a material to be vaporized and comprises a plurality of first pores of a 100-500 nm diameter and a plurality of second pores of a 20-100 nm diameter. A ratio of the number of the second pores N2 to the number of the first pores N1 in a unit area, i.e., N2/N1, is 10-50%. The heating element heats and vaporizes the material to be vaporized in the absorber.

In an embodiment, the absorber has a porosity of 45-75%.

In an embodiment, the absorber comprises a first material and a second material. The first material is selected from the group consisting of aluminum oxide, silicon carbide, sodium silicate and ferrite. The second material is selected from the group consisting of active carbon, kaolinite, halloysite, montmorillonite, calcium phosphate, zeolite, vermiculite, diatomite, palygorskite, sepiolite and perlite.

In an embodiment, the absorber comprises the first material of 15-35% by volume and the second material of 15-35% by volume.

In an embodiment, the second material has a greater volume percent than the first material.

In an embodiment, the heating element has a temperature of 200-250° C. after heating for two seconds.

In an embodiment, the absorber absorbs the material to be vaporized in 1-8 seconds.

In an embodiment, the absorber absorbs the material to be vaporized with a contact angle of 0-10 degrees.

In an embodiment, the absorber has a mechanical strength of greater than 15N.

In an embodiment, the absorber comprises ferrite of 1-10% by volume.

In accordance with a second aspect of the present application, a vaporizing apparatus comprises a housing, an absorber, a heating element and a battery. The housing encloses a reservoir for storing a material to be vaporized. The absorber is configured to absorb the material to be vaporized and comprises a plurality of first pores of a 100-500 nm diameter and a plurality of second pores of a 20-100 nm diameter. A ratio of the number of the second pores N2 to the number of the first pores N1 in a unit area, i.e., N2/N1, is 10-50%. The heating element heats and vaporizes the material to be vaporized in the absorber. The battery provides power to the heating element.

Both the vaporizing apparatus and the vaporizer of the present application comprise an absorber to absorb the material to be vaporized. For electronic cigarette applications, the material to be vaporized, e.g., e-liquid, can be absorbed quickly and a surface of the absorber adjacent to the heating element has no e-liquid leakage by using the absorber of an adequate ratio of large pores and small pores. Moreover, a large amount and rich taste of smoke can be obtained to provide a solution for current electronic cigarettes.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed below in detail. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
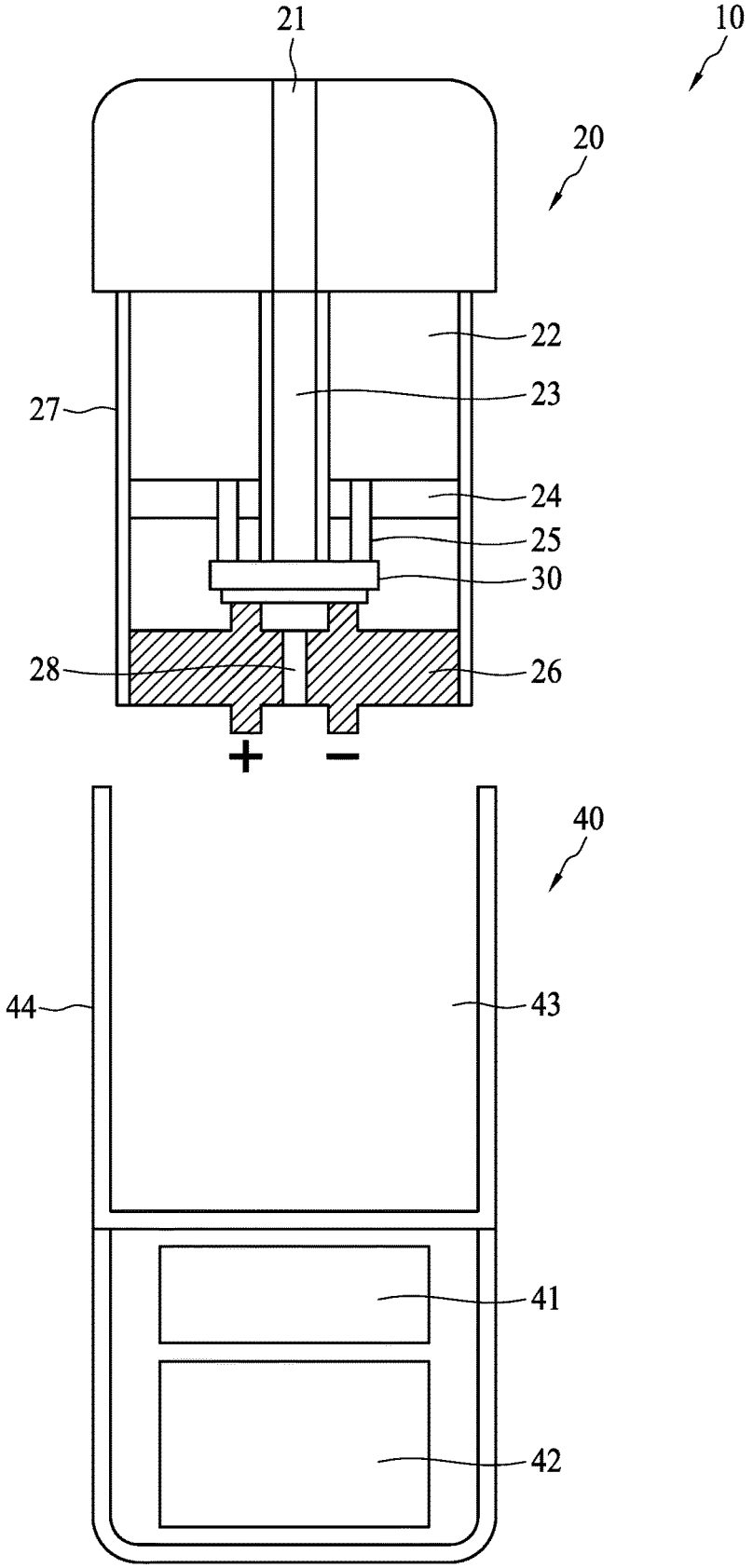
FIG. 1 shows a vaporizing apparatus in accordance with an embodiment of the present application.

FIG. 1 shows a vaporizing apparatus 10 which can be applied to an electronic cigarette. The vaporizing apparatus 10 may be in a flat or cylindrical shape and comprises a suction nozzle 20 and a power supply 40. The power supply 40 has a cavity 43 to receive a main portion of the suction nozzle 20 and is combined with the suction nozzle 20. Accordingly, the suction nozzle 20 is replaceable.

The suction nozzle 20 comprises an outlet channel 21, a reservoir 22, a smoke channel 23, an isolating member 24, liquid channels 25, an electrode set 26, a housing 27, an air inlet channel 28 and a vaporizer 30. The reservoir 22 stores the material or liquid to be vaporized, e.g., e-liquid or e-juice. In an embodiment, the reservoir 22 can be a room or space enclosed and constituted by the housing 27 and the isolating member 24 to accommodate the material or liquid to be vaporized. The isolating member 24 comprises two liquid channels 25 connecting the reservoir 22 and the vaporizer 30. The material or liquid can flow through the liquid channels 25 to be in contact with the vaporizer 30 for being vaporized. The electrode set 26 is an interface to provide power to heat the vaporizer 30. The electrode set 26 includes the air inlet 28. The power supply 40 includes a control circuit 41, a battery 42 and a housing 44. The housing 44 constitutes the cavity 43 to receive the suction nozzle 20. The control circuit 41 determines the timing of the battery 42 to provide heating power to the vaporizer 30.

Figure 2:
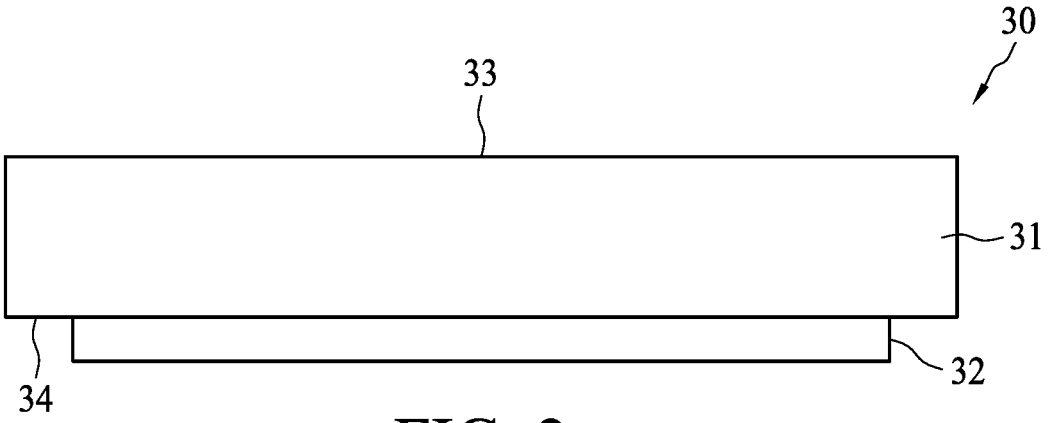
FIG. 2 shows a lateral view of a vaporizer in accordance with an embodiment of the present application.
Figure 3:
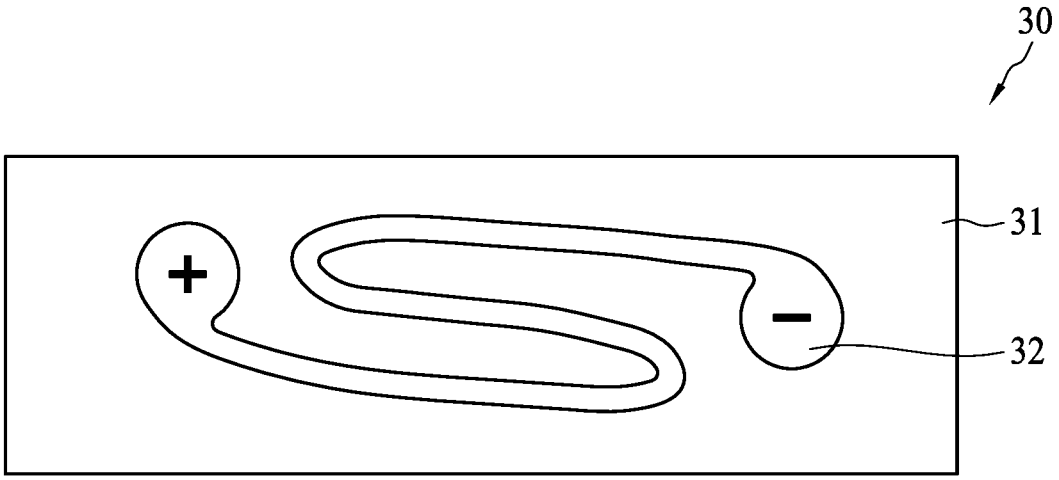
FIG. 3 shows a bottom view of the vaporizer in FIG. 2.

FIG. 2 shows a lateral view of the vaporizer 30 in accordance with an embodiment of the present application. FIG. 3 is a bottom view of the vaporizer 30. The vaporizer 30 comprises an absorber 31 and a heating element 32. The absorber 31 comprises a first surface 33 and a second surface 34. The first surface 33 and the second surface 34 are at opposite sides of the absorber 31. In an embodiment, the material to be vaporized is in direct contact with the first surface 33 and the heating element 32 is in direct contact with the second surface 34. The heating element 32 may be a resistance-type heater using ceramic core of which the heating is not linearly proportional to time. The heating element 32 may comprises silver (Ag), ruthenium (Ru), silver-palladium alloy (AgPd), nickel-chromium alloy (Ni—Cr), or copper-nickel alloy (Cu—Ni). Because users usually smoke for two seconds at one time, a temperature of the heating element 32 after heating for two seconds is employed to evaluate heating efficiency.

Figure 4:
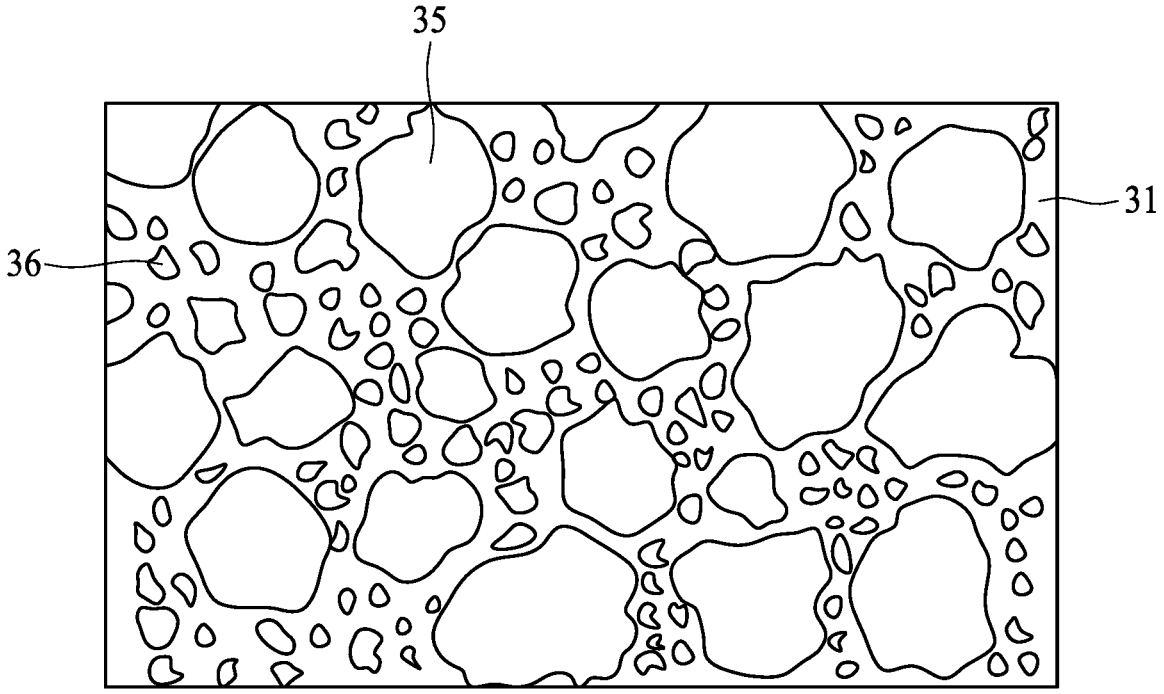
FIG. 4 shows a cross-sectional magnification view of an absorber of a vaporizer in accordance with an embodiment of the present application.

FIG. 4 shows a cross-sectional magnification view of the absorber 31. The absorber 31 comprises a plurality of first pores 35 and a plurality of second pores 36 with different pore sizes. The first pores 35 are larger pores of a 100-500 nm diameter and the second pores 36 are smaller pores of a 20-100 nm diameter. The larger pores can be made by filling porogens of a specified size and volume percent in ceramic powder to obtain an adequate porosity and followed by pressing and sintering. The pores are formed after the porogens are heated and volatilized. The smaller pores may be made of micropore material and will be described later. By selecting and adjusting the first and second pores with adequate diameters and volume percent, e-liquid can be absorbed quickly without leakage. Moreover, a large amount of smoke and rich taste can be attained for electronic cigarette applications.

Table 1 shows data of vaporizers of Embodiments E1-E5 and Comparative example C1-C5, including volume percent of a main component (a first material), volume percent of a micropore component (a second material), size and volume percent of a porogen, a ratio of the number of small pores to the number of large pores per unit area, porosity, absorbing efficiency, mechanical strength and heating efficiency. In addition, the vaporizer with e-liquid is tested to evaluate the amount of smoke and taste by vision and olfaction. The main components of E1-E5 and C1-C5 include aluminum oxide. Alternatively, silicon carbide, sodium silicate, ferrite and the like can be used. The micropore components include active carbon, and kaolinite, halloysite, montmorillonite, calcium phosphate, zeolite, vermiculite, diatomite, palygorskite, sepiolite or perlite can be used alternatively. In E1-E5, the absorber comprises the main component of 15-35% by volume and the micropore component of 15-35% by volume. In an embodiment, the micropore component has a larger volume percent than the main component. C1-C4 shows bad absorbing efficiency in case that the main component has a larger volume percent than the micropore component. E1-E5 have a porogen of 35-70% by volume and C1-C5 have porogen of 30-70% by volume. The porogen is carbon black, and may alternatively use starch, short carbon fiber or plastic material such as polymethyl methacrylate (PMMA), polyvinyl alcohol (PVA) or polyvinyl butyral (PVB). In E1-E5, the porosity is 45-75%. The determination of porosity is in light of ASTM C20 or ASTM C373. The cross-sectional view of the absorber shows that a ratio of the number of the second pores N2 to the number of the first pores N1 in a unit area, i.e., N2/N1, is 10-50%. N1 and N2 are the numbers of the pores per square millimeter ($mm^2$) calculated based on an area of 0.44 mm×0.32 mm of a 20× magnification. The pore size is the mean diameter measured based on a 20× magnification. In e-liquid tests, E1-E5 show good e-liquid absorbing efficiency and good mechanical strength without leakage. In E1-E5, the absorbing time of the absorber is 1-8 seconds, the contact angle of the e-liquid is equal to or less than 10 degrees and the mechanical strength of the absorber is greater than 15N. A large contact angle indicates e-liquid is not easily absorbed due to surface tension, and a small contact angle indicates e-liquid can be absorbed quickly. C1-C3 do not contain micropore component, and therefore the absorber has larger first pores and no smaller second pores, i.e., N2/N1=0. In C1-C3, the contact angles are 40-60 degrees and the absorbing times significantly increase to 12-20 seconds. The ratio N2/N1 of C4 is 7.53% and N2/N1 of C5 is 77.92%; they are not in the range of 10-50% and either too large or too small. The contact angles of C4 and C5 are larger than 20 degrees, and the absorbing times are equal to or greater than 8 seconds. The absorbing efficiency of C4 and C5 is apparently worse than E1-E5. C5 has the second pores of a large volume percent, resulting in the mechanical strength is only 8N. In the vaporizer testing, the temperature of the heating element of E1-E5 and C1-C5 after heating up for two seconds is 200-250° C. The amount of smoke is graded into three levels of large, medium and small and the smell of smoke is graded into three levels of rich, medium and bland. The tests are done by a same person to reduce bias. E1-E5 shows a large amount of smoke and rich taste. In C1-C5, only C5 shows a large amount of smoke, others show a small or medium amount of smoke and medium or bland taste.

TABLE 1

| | Main component (vol %) | Porogen (size/vol/%) | Micropore component (vol %) | N2/N1 | Porosity | Absorbing efficiency: Absorbing time (s) | Absorbing efficiency: Contact angle (°) | Mechanical (N) strength | Heating element (° C. @2 s) temperature | Test for vaporizer: Smoke amount | Test for vaporizer: Taste |
|---|---|---|---|---|---|---|---|---|---|---|---|
| E1 | 30% | 80 μm 38% | 32% | 47.06% | 50% | 5-8 | 10 | 43 | 200-250 | Large | Rich |
| E2 | 22% | 80 μm 53% | 25% | 25.00% | 57% | 3-6 | 0 | 26 | 200-250 | Large | Rich |
| E3 | 20% | 80 μm 58% | 22% | 20.48% | 67% | 3-4 | 0 | 21 | 200-250 | Large | Rich |
| E4 | 18% | 80 μm 63% | 19% | 16.28% | 68% | 2-4 | 0 | 19 | 200-250 | Large | Rich |
| E5 | 16% | 80 μm 67% | 17% | 13.64% | 70% | 2-3 | 0 | 18 | 200-250 | Large | Rich |
| C1 | 34% | 80 μm 66% | 0% | 0% | 61% | 12-15 | 60 | 32 | 200-250 | Medium | Medium |
| C2 | 42% | 80 μm 58% | 0% | 0% | 58% | 13-16 | 40 | 29 | 200-250 | Medium | Bland |
| C3 | 49% | 12 μm 51% | 0% | 0% | 50% | 15-20 | 40 | 42 | 200-250 | Small | Bland |
| C4 | 40% | 80 μm 53% | 7% | 7.53% | 58% | 12-13 | 40 | 42 | 200-250 | Medium | Medium |
| C5 | 22% | 80 μm 33% | 45% | 77.92% | 42% | 8-12 | 20 | 8 | 200-250 | Large | Medium |

It can be seen from Table 1 that the vaporizer of the present application can obtain good absorbing efficiency and mechanical strength without e-liquid leakage by adding micropore component of an adequate volume percent and adjusting N2/N1. For electronic cigarette applications, the vaporizer can meet the demand of a large amount of smoke and rich taste which are not attainable by the pores of a single diameter formed by traditional porogens.

Because of ceramic porosity, the vaporizer is difficult to be manufactured by automation. Magnetic vaporizer is further developed to verify the feasibility of automation. In Table 2 Embodiments E6-E10, ferrite of 1-10% by volume is added to the absorber of the vaporizer and magnet is used to test pickup performance. The ferrite uses NiCuZn ferrite. Alternatively, MnZn ferrite or NiZn ferrite can be used. The vaporizers of E6-E10 can be picked up by a magnet and thus they are suitable for automation. E6-E10 is modified based on E1-E5 with ferrite addition in which the absorbing time, contact angle, the amount of smoke and taste are similar to E1-E5. For example, the absorbing time of the absorber is 1-8 seconds, the contact angle of the e-liquid is 0-10 degrees, the mechanical strength of the absorber is greater than 15N and the temperature of the heating element after heating up for two seconds is 200-250° C. C6 and C7 contain ferrite of 0.5% and 0.3% by volume, respectively; however the small amount of ferrite cannot generate sufficient magnetism to be picked up. C8-C10 have no ferrite addition, and thus cannot be picked up by a magnet.

TABLE 2

| | Main component (vol %) | Porogen (size/vol/%) | Micropore component (vol %) | Ferrite (vol %) | N2/N1 | Porosity | Absorbing efficiency: Absorbing time (s) | Absorbing efficiency: Contact angle (°) | Test for vaporizer: Smoke amount | Test for vaporizer: Taste | Pickup by magnet |
|---|---|---|---|---|---|---|---|---|---|---|---|
| E6 | 29.7% | 80 μm 37.6% | 31.7% | 1% | 47.06% | 50% | 5-8 | 10 | Large | Rich | Yes |
| E7 | 21.5% | 80 μm 51.7% | 24.4% | 2.4% | 25% | 57% | 3-6 | 0 | Large | Rich | Yes |
| E8 | 19% | 80 μm 55.2% | 21.0% | 4.8% | 20.48% | 67% | 3-4 | 0 | Large | Rich | Yes |
| E9 | 16.7% | 80 μm 58.6% | 17.7% | 7% | 16.28% | 68% | 2-4 | 0 | Large | Rich | Yes |
| E10 | 14.5% | 80 μm 60.9% | 15.5% | 9.1% | 13.64% | 70% | 2-3 | 0 | Large | Rich | Yes |
| C6 | 33.8% | 80 μm 65.7% | 0% | 0.5% | 0% | 61% | 12-15 | 60 | Medium | Medium | No |
| C7 | 41.9% | 80 μm 57.8% | 0% | 0.3% | 0% | 58% | 13-16 | 40 | Medium | Bland | No |
| C8 | 49% | 12 μm 51.0% | 0% | 0% | 0% | 50% | 15-20 | 40 | Small | Bland | No |
| C9 | 40% | 80 μm 53.0% | 7% | 0% | 7.53% | 58% | 12-13 | 40 | Medium | Medium | No |
| C10 | 22% | 80 μm 33.0% | 45% | 0% | 77.92% | 42% | 8-12 | 20 | Large | Medium | No |

As shown in Table 2, the absorber with ferrite addition can obtain good absorbing efficiency, a large amount of smoke and rich taste without e-liquid leakage. The vaporizer with magnetism can be picked up for automation to increase production efficiency and lower production cost.

The above-described embodiments of the present invention are intended to be illustrative only. Numerous alternative embodiments may be devised by persons skilled in the art without departing from the scope of the following claims.

What is claimed is:

1. A vaporizer, comprising:

an absorber configured to absorb a material to be vaporized and comprising a plurality of first pores of a 100-500 nm diameter and a plurality of second pores of a 20-100 nm diameter, a ratio of the number of the second pores N2 to the number of the first pores N1 in a unit area is 10-50%; and a heating element heating and vaporizing the material to be vaporized in the absorber.

2. The vaporizer of claim 1, wherein the absorber has a porosity of 45-75%.

3. The vaporizer of claim 1, wherein the absorber comprises a first material and a second material, the first material is selected from the group consisting of aluminum oxide, silicon carbide, sodium silicate and ferrite, and the second material is selected from the group consisting of active carbon, kaolinite, halloysite, montmorillonite, calcium phosphate, zeolite, vermiculite, diatomite, palygorskite, sepiolite and perlite.

4. The vaporizer of claim 3, wherein the absorber comprises the first material of 15-35% by volume and the second material of 15-35% by volume.

5. The vaporizer of claim 3, wherein the second material has a greater volume percent than the first material.

6. The vaporizer of claim 1, wherein the heating element has a temperature of 200-250° C. after heating for two seconds.

7. The vaporizer of claim 1, wherein the absorber absorbs the material to be vaporized in 1-8 seconds.

8. The vaporizer of claim 1, wherein the absorber absorbs the material to be vaporized with a contact angle of 0-10 degrees.

9. The vaporizer of claim 1, wherein the absorber has a mechanical strength of greater than 15N.

10. The vaporizer of claim 1, wherein the absorber comprises ferrite of 1-10% by volume.

11. A vaporizing apparatus, comprising:

a housing enclosing a reservoir for storing a material to be vaporized;

an absorber configured to absorb the material to be vaporized and comprising a plurality of first pores of a 100-500 nm diameter and a plurality of second pores of a 20-100 nm diameter, a ratio of the number of the second pores N2 to the number of the first pores N1 in a unit area is 10-50%;

a heating element heating and vaporizing the material to be vaporized in the absorber; and a battery providing power to the heating element.

12. The vaporizing apparatus of claim 11, wherein the absorber comprises a first material and a second material, the first material is selected from the group consisting of aluminum oxide, silicon carbide, sodium silicate and ferrite, and the second material is selected from the group consisting of active carbon, kaolinite, halloysite, montmorillonite, calcium phosphate, zeolite, vermiculite, diatomite, palygorskite, sepiolite and perlite.

13. The vaporizing apparatus of claim 12, wherein the absorber comprises the first material of 15-35% by volume and the second material of 15-35% by volume.

14. The vaporizing apparatus of claim 11, wherein the absorber comprises ferrite of 1-10% by volume.

* * * * *